US006918799B2

(12) United States Patent
Zhu et al.

(10) Patent No.: US 6,918,799 B2
(45) Date of Patent: Jul. 19, 2005

(54) ELECTRICAL CONNECTOR HAVING CONTACT WITH PRE-PRESSING STRUCTURE

(75) Inventors: ZiQiang Zhu, Kunsan (CN); Hon Qiang Han, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 4 days.

(21) Appl. No.: 10/602,249

(22) Filed: Jun. 23, 2003

(65) Prior Publication Data

US 2004/0224563 A1 Nov. 11, 2004

(30) Foreign Application Priority Data

May 7, 2003 (TW) ..... 92208370 U

(51) Int. Cl.[7] ..... H01R 13/04
(52) U.S. Cl. ..... 439/862; 439/668
(58) Field of Search ..... 439/607, 668, 439/669, 862, 676

(56) References Cited

U.S. PATENT DOCUMENTS 3,742,430 A * 6/1973 Cairns et al. ..... 439/862
4,357,066 A * 11/1982 Cairns et al. ..... 439/862
6,056,602 A 5/2000 Wu
6,368,156 B1 * 4/2002 Lin ..... 439/668
6,371,771 B1 * 4/2002 Fan ..... 439/79
6,375,498 B1 * 4/2002 Yu et al. ..... 439/567
6,524,130 B1 2/2003 Yeh
6,616,485 B2 * 9/2003 Harasawa et al. ..... 439/862

* cited by examiner

*Primary Examiner*—Renee Luebke
(74) *Attorney, Agent, or Firm*—Wei Te Chung

(57) ABSTRACT

An electrical connector (1) includes an insulative housing (10) defining a receiving space (111) and a passageway (120) communicating with the receiving space, and an electrical contact (21) received in the passageway of the insulative housing. The electrical contact includes a body portion (210), a resilient arm (211) having a contact portion (212) projecting into the receiving space of the insulative housing and an extension (213) extending from the contact portion, and a tab (215) extending from the body portion and having a pressing portion (216) pressing the extension of the resilient arm to deflect the resilient arm toward the body portion.

15 Claims, 6 Drawing Sheets

ELECTRICAL CONNECTOR HAVING CONTACT WITH PRE-PRESSING STRUCTURE

BACKGROUND OF THE INVENTION

1. Field of the Invention

The present invention relates to an electrical connector, and more particularly to an electrical connector having a contact with pre-pressing structure.

2. Description of Related Art

Plug and jack type connectors are well known for use in connecting electrical equipments. A plug connector generally comprises a plug pin. A jack connector generally comprises a central contact having a resilient arm slantedly extending in a receiving space thereof. When the plug pin is inserted into the receiving space, the resilient arm of the central contact abuts against the plug pin to electrically connect the plug pin and the central contact. In order to increase the mating force between the plug pin and the resilient arm of the central contact for a reliable electrical connection therebetween, a method is provided to increase a length and a slope of the resilient arm. However, the increased resilient arm needs a large enough receiving space to accommodate it, which increases dimensions of the jack connector. In addition, the increased resilient arm adversely affects setting of other contacts of the jack connector.

A solution to the above problem is to provide a second contact which presses the resilient arm of the central contact before the plug pin is inserted into the receiving space of the jack connector. The additional second contact needs an additional separate mold to be manufactured, which will increase the cost of the jack connector. Another solution is to provide a housing with a pressing structure used to pre-stress the resilient arm of the central contact before the plug pin is inserted into the receiving space of the jack connector. A disadvantage of this solution is that the pressing structure complicates the structure of the housing of the jack connector and the assembly procedure of the central contact.

Hence, an electrical connector having an improved pre-pressing structure is desired.

SUMMARY OF THE INVENTION

An object of the present invention is to provide an electrical connector having a contact with a pre-pressing structure which can reduce the dimensions of the electrical connector.

To achieve the above object, an electrical connector in accordance with the present invention comprises an insulative housing defining a receiving space and a passageway communicating with the receiving space, and an electrical contact received in the passageway of the insulative housing. The electrical contact comprises a body portion, a resilient arm having a contact portion projecting into the receiving space of the insulative housing and an extension extending from the contact portion, and a tab extending from the body portion and having a pressing portion pressing the extension of the resilient arm to deflect the resilient arm toward the body portion.

Other objects, advantages and novel features of the invention will become more apparent from the following detailed description when taken in conjunction with the accompanying drawings.

DETAILED DESCRIPTION OF THE INVENTION

Figure 1:
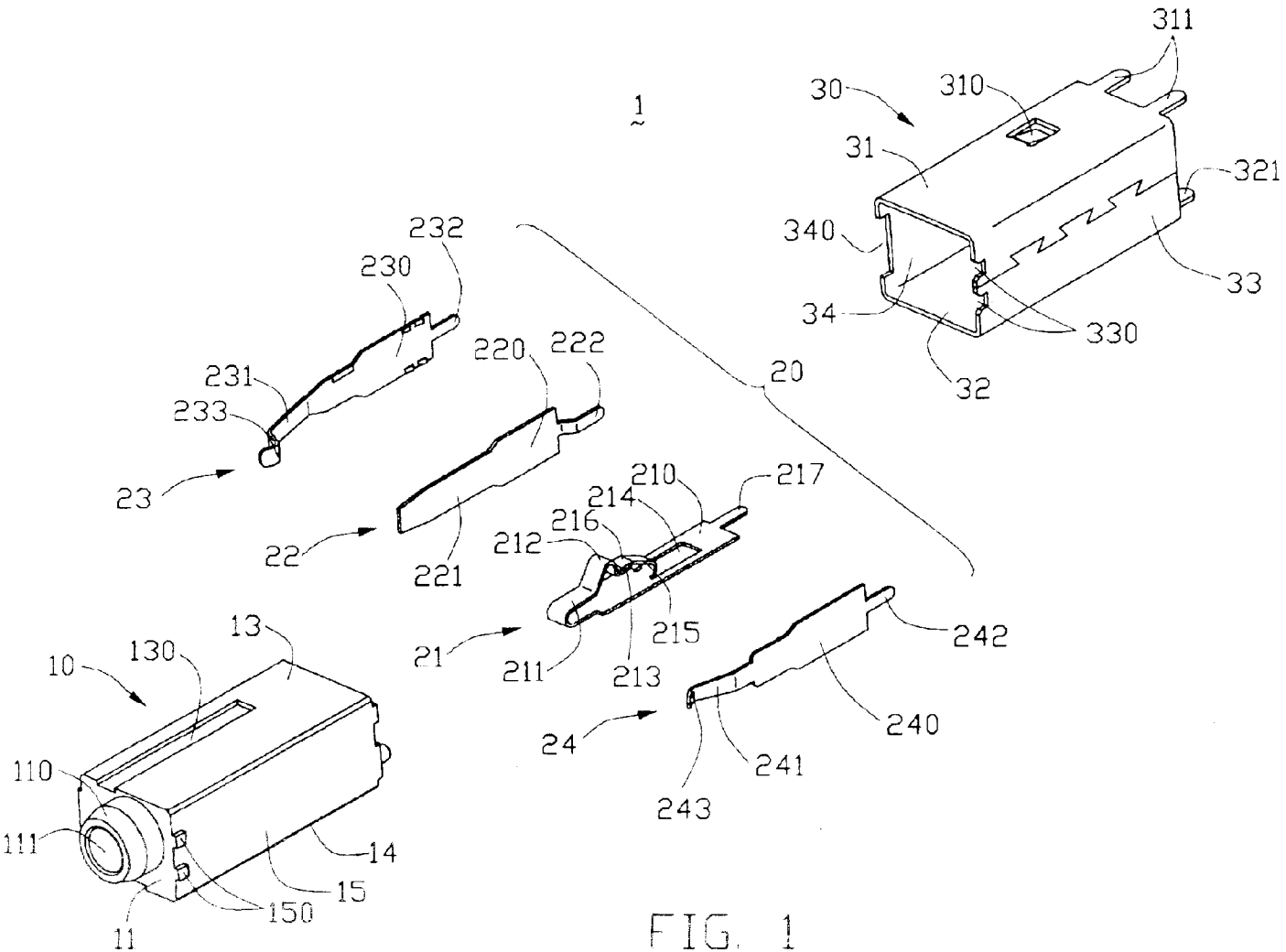
FIG. 1 is an exploded perspective view of an electrical connector in accordance with the present invention.
Figure 2:
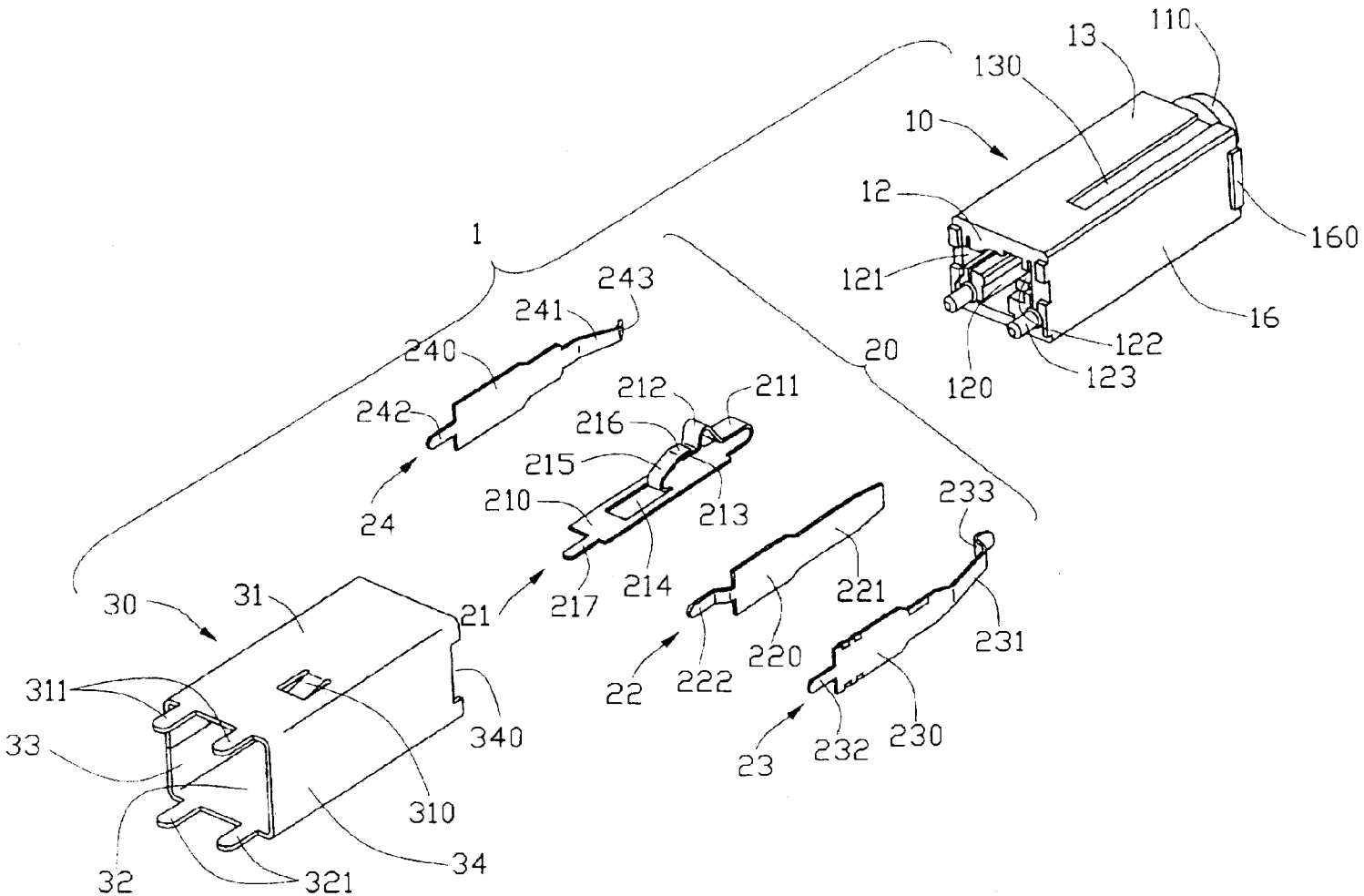
FIG. 2 is a view similar to FIG. 1 but taken from a different aspect.
Figure 3:
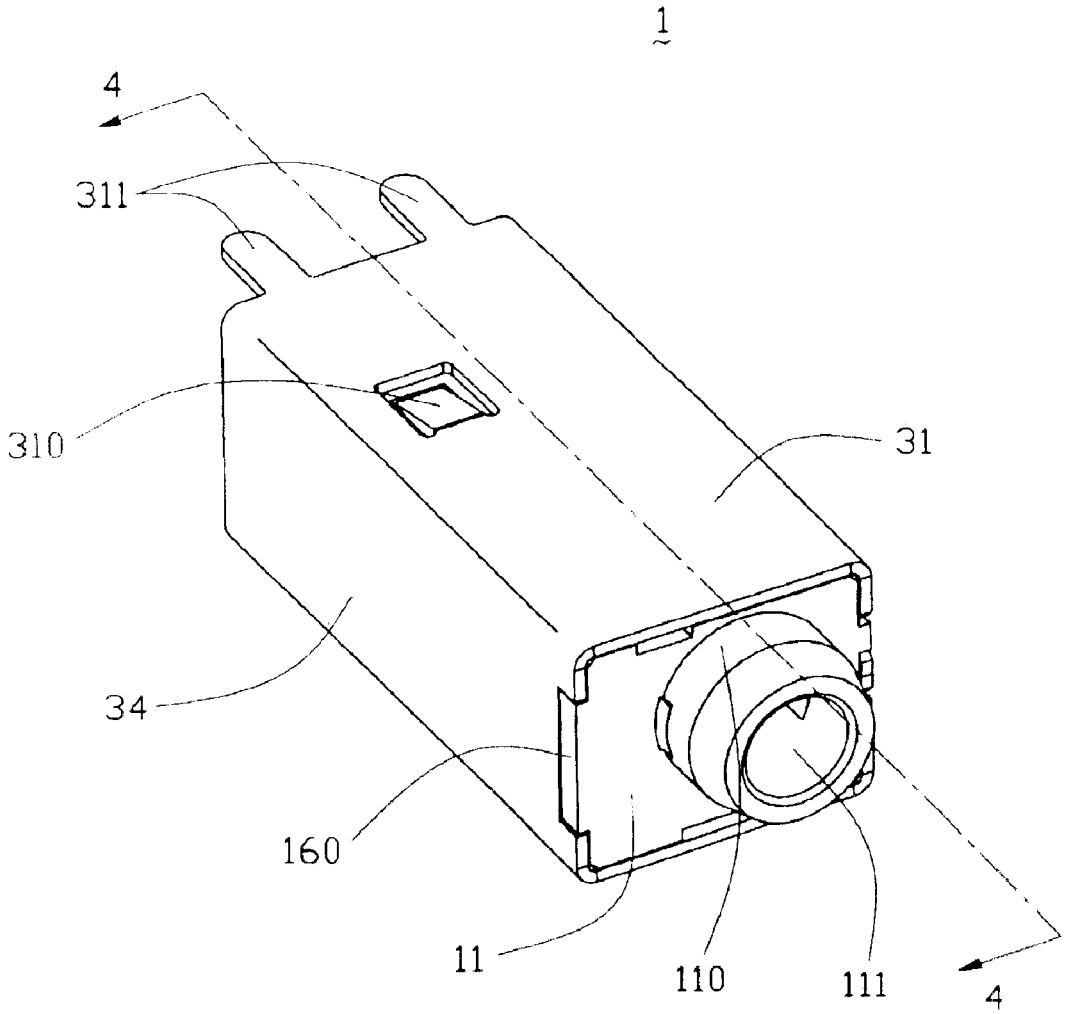
FIG. 3 is an assembled perspective view of the electrical connector of FIG. 1 but taken from a different aspect.

Referring to FIGS. 1, 2 and 3, an electrical connector 1 in accordance with the present invention comprises an insulative housing 10, a plurality of electrical contacts 20, and a metallic shell 30.

The insulative housing 10 has a front face 11, a rear face 12 opposite to the front face 11, a top face 13, a bottom face 14 opposite to the top face 13, and two opposite side faces 15, 16. The insulative housing 10 is formed with a mating portion 110 extending forwardly from the front face 11. The mating portion 110 defines a receiving space 111 extending rearwardly through the insulative housing 10. The insulative housing 10 defines a top groove 130 in the top face 13 and a bottom groove 140 in the bottom face 14. A pair of projections 150 are formed on the front end of the side face 15 and a projection 160 is formed on the front end of the side face 160. The insulative housing 10 defines a central passageway 120, a left passageway 121 and a right passageway 122. The central passageway 120 is located below the receiving space 111 and communicates with the receiving space 111. The left and the right passageways 121, 122 are located on the left and right of the receiving space 111 and communicate with the receiving space 111 respectively. A pair of guide posts 123 extend rearwardly from the rear face 120 of the insulative housing 10.

The electrical contacts 20 comprises a central contact 21, a stationary contact 22, a switching contact 23 and a signal contact 24. The central contact 21 is stamped and formed from a piece of metal and comprises an elongated body portion 210, a resilient arm 211 extending forwardly from a front end of the body portion 210, and tail portion 217 extending rearwardly from the body portion 210. The resilient arm 211 is stamped and formed with a curved contact portion 212 projecting downwardly and an extension 213 extending forwardly from the contact portion 212. Then the resilient arm 211 is bent upwardly and rearwardly at a sharp angle to the body portion 210. An opening 214 is punched in the body portion 210 along a longitudinal direction thereof and with a tab 215 extending from a front wall of the opening 214. The tab 215 is bent upwardly and forwardly and is formed with a pressing portion 216 on a distal end thereof. The pressing portion 216 presses the extension 213 of the resilient arm 211 and deflects the resilient arm 211 toward the body portion 210.

The contact 22 (23, 24) comprises a body portion 220 (230, 240), a contact arm 221 (231, 241) extending forwardly from the body portion 220 (230,240) and a tail portion 222 (232,242) extending rearwardly from the body portion 220 (230, 240). The contact arms 231, 241 are formed with contact portions 233, 243, respectively.

The metallic shell 30 comprises a top wall 31, a bottom wall 32 opposite to the top wall 31, two opposite side walls 33, 34 and a plurality of solder portions 311, 321 extending rearwardly from the top and the bottom walls 31, 32. The top and the bottom wall are formed and stamped with tabs 310, 320 respectively. The tabs 310, 320 extend inwardly and rearwardly. The side wall 33 defines a pair of gaps 330 on a front end thereof and the side wall 34 defines a gap 340 on a front end thereof.

In assembly, the contacts 21, 22, 23 and 24 are assembled to the insulative housing 10 from the rear face 12 of the insulative housing 10. The central contact 21 is received in the central passageway 120 with the contact portion 212 projecting into the receiving space 111. The stationary and the switching contacts 22, 23 are received in the right passageway 122 of the insulative housing 10 with the contact arm 221 abutting against the contact arm 231 and the contact portion 233 projecting into the receiving space 111. The signal contact 24 is received in the left passageway 121 of the insulative housing 10 with the contact portion 243 projecting into the receiving space 111. The tail portions 217, 222, 232, 242 of the contacts 21, 22, 23,24 extend rearwardly beyond the rear face 12 of the insulative housing 10. The metallic shell 30 encloses the insulative housing 10. The tabs 310, 320 abut against rear end walls of the grooves 130, 140 in the top and the bottom faces 13, 14 of the insulative housing 10 respectively to prevent the metallic shell 30 from moving rearwardly. The projections 150, 160 on the side faces 15, 16 of the insulative housing 10 engage with the gaps 330, 340 on the side walls 33, 34 of the metallic shell 30 to prevent the metallic shell 30 from moving forwardly. The solder portion 311, 321 extend rearwardly beyond the rear face 12 of the insulative housing 10.

Figure 4:
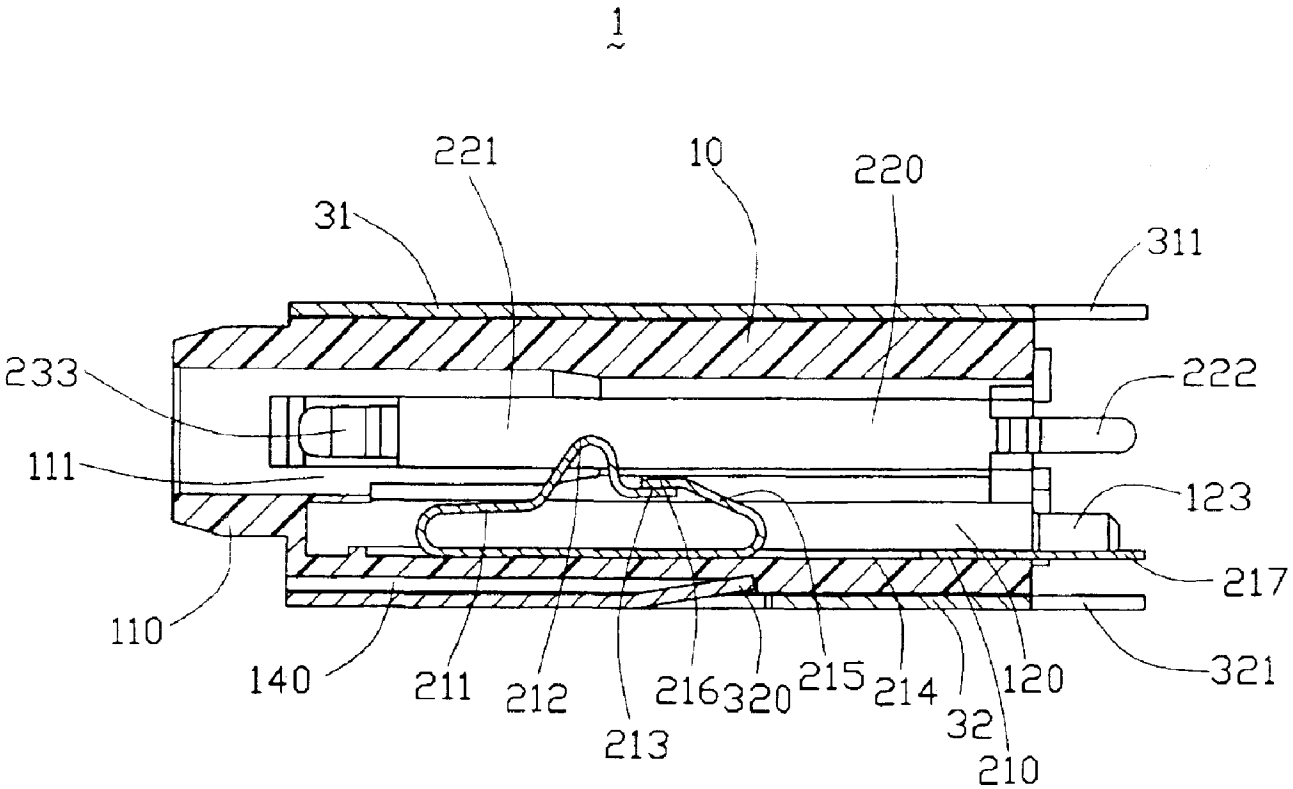
FIG. 4 is a cross-sectional view of the electrical connector taken along line 4—4 of FIG. 3.
Figure 5:
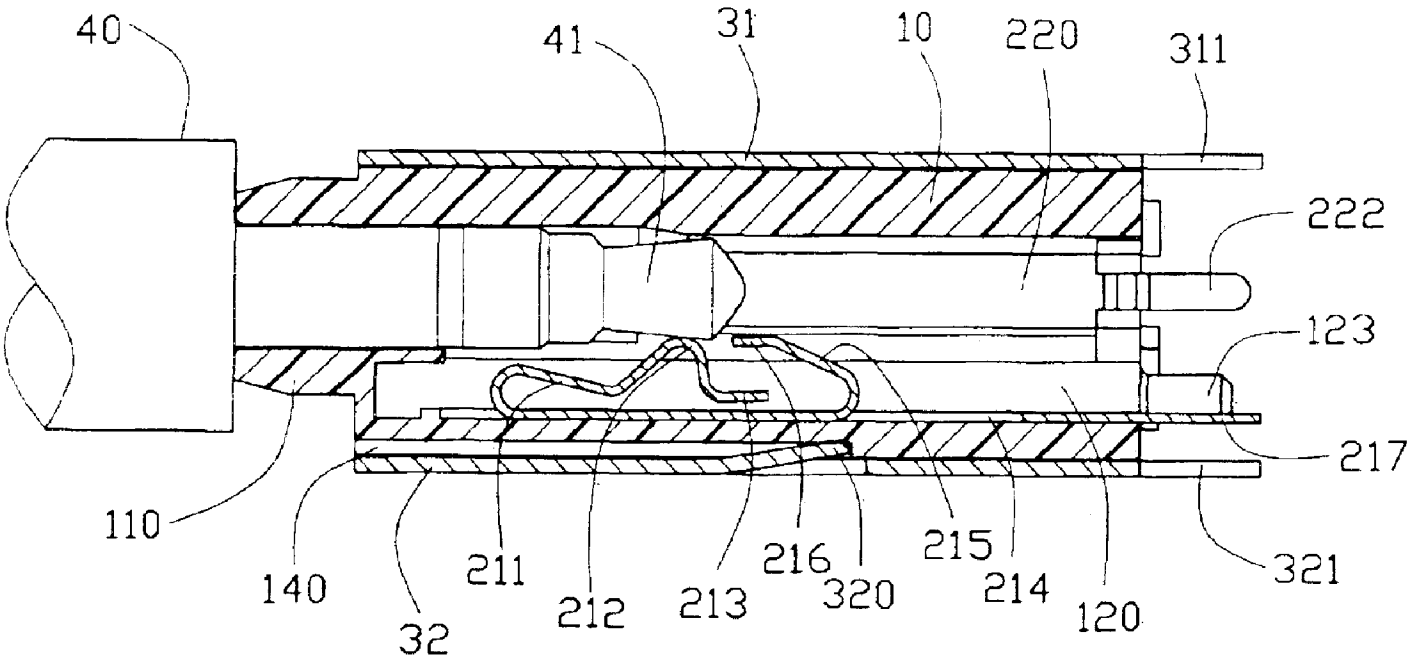
FIG. 5 is a view similar to FIG. 4 but the electrical connector is mated with a complementary connector.

Referring to FIGS. 4 and 5, when the electrical connector 1 is not mated with a complementary plug connector 40, the pressing portion 216 of the tab 215 presses the extension 13 of the resilient arm 211 and deflects the resilient arm 211 toward the body portion 210, thereby economizing space of the receiving space 111 and reducing the dimensions the electrical connector 1. When the electrical connector 1 is mated with the plug connector 40, a mating pin 41 of the plug connector 40 presses the contact portion 212 of the resilient arm 211 of the central contact 21 and further deflects the resilient arm 21. The extension 213 of the resilient arm 21 disengages from the pressing portion 216 of the tab 215. The contact portion 212 abuts against the mating pin 41 firmly, so a reliable electrical connection between the central contact 21 and the mating pin 41 is obtained.

Figure 6:
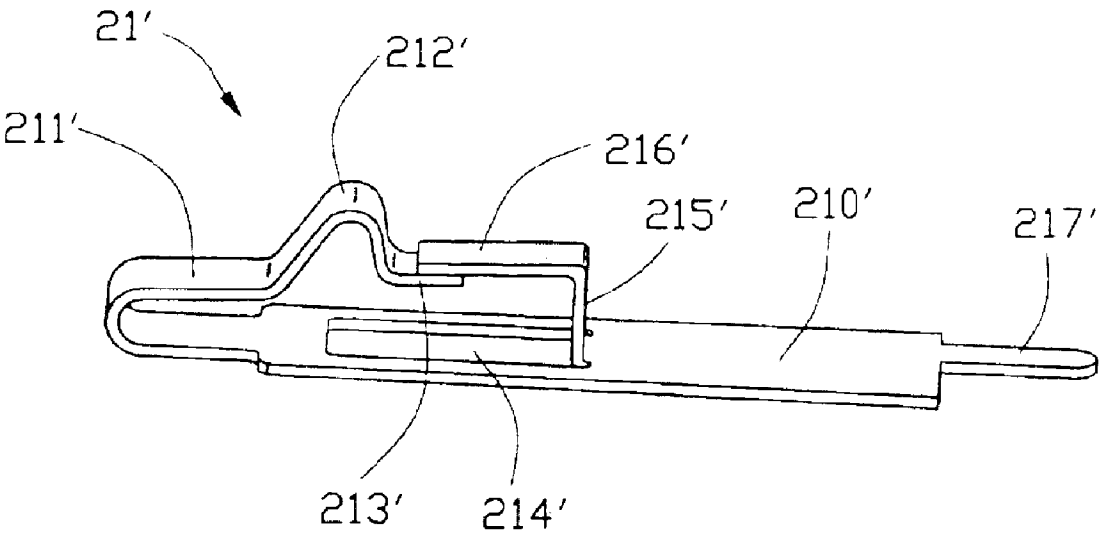
FIG. 6 is a perspective view of a central contact in accordance with a second embodiment of the present invention.

Referring to FIG. 6, a central contact 21' in accordance with a second embodiment of the present invention is stamped and formed from a piece of metal and comprises an elongated body portion 210', a resilient arm 211' extending forwardly from a front end of the body portion 210', and a tail portion 217' extending rearwardly from the body portion 210'. The resilient arm 211' is stamped and formed with a curved contact portion 212' projecting downwardly and an extension 213' extending forwardly from the contact portion 212'. An opening 214' is punched in the body portion 210' along a longitudinal direction thereof and with a tab 215' extending upwardly from a rear wall of the opening 214'. Then the resilient arm 211' is bent upwardly and rearwardly at a sharp angle to the body portion 210'. A distal end of the tab 215' is bent forwardly to form a pressing portion 216'. The pressing portion 216' presses the extension 213' of the resilient arm 211' and deflects the resilient arm 211' toward the body portion 210'. The difference between the central contact 21 and 21' is that the tab 215 extends from the front end wall of the opening 214 but the tab 215' extends from the rear end wall of the opening 214'. Since the opening 214' is located under the resilient arm 211' and the tab 215', the body portion 210' can be reduced when needed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a receiving space and a first passageway communicating with the receiving space; and an electrical contact received in the first passageway and comprising a body portion extending in a longitudinal direction, an opening defined in the body portion along the longitudinal direction, a tab extending upwardly from a side wall thereof, and a resilient arm extending upwardly and rearwardly from a front end of the body portion, the resilient arm having a contact portion projecting into the receiving space of the insulative housing and an extension formed at a distal free end of the contact portion, the tab having a pressing portion holding the extension of the resilient arm and deflecting the resilient arm toward the body portion when no electronic member is inserted into the receiving space; and a second, a third, and a fourth electrical contact, the insulative housing defining a second passageway communicating with the receiving space to receive the second and the third electrical contacts and a third passageway communicating with the receiving space to receive the fourth electrical contact; wherein said second electrical contact comprise a body portion, a contact arm extending forwardly from the body portion and a tail portion extending rearwardly from the body portion; and wherein said third electrical contact comprise a body portion, a contact arm extending forwardly from the body portion and abutting against the contact arm of the second electrical contact, a contact portion, formed on a free end of the contact arm and projecting into the receiving space of the insulative housing, and a tail portion extending rearwardly from the body portion.

2. The electrical connector as claimed in claim 1, wherein the tab extends from a front wall of the opening.

3. The electrical connector as claimed in claim 1, wherein the tab extends from a rear wall of the opening.

4. The electrical connector as claimed in claim 1, wherein the electrical contact comprises a tail portion extending rearwardly from the body portion.

5. The electrical connector as claimed in claim 1, wherein the fourth electrical contact comprises a body portion, a contact arm extending forwardly from the body portion, a contact portion formed on a free end of the contact arm, and a tail portion extending rearwardly from the body portion.

6. The electrical connector as claimed in claim 1, wherein the insulative housing comprises a front face, a rear face opposite to the front face, a top face, a bottom face opposite to the top face, a first side face, and a second side face opposite to the first side face.

7. The electrical connector as claimed in claim 6, wherein the insulative housing is formed with a mating portion extending forwardly from the front face thererof, and wherein the receiving space is defined in the mating portion and extending rearwardly through the insulative housing.

8. The electrical connector as claimed in claim 7, wherein the first passageway extends forwardly from the rear face of the insulative housing and is located below the receiving space.

9. The electrical connector as claimed in claim 7, wherein the second passageway extends forwardly from the rear face of the insulative housing and is located on the right of the receiving face of the insulative housing, and wherein the third passageway extends forwardly from the rear face of the insulative housing and is located on the left of the receiving face of the insulative housing.

10. The electrical connector as claimed in claim 6 further comprising a metallic shell enclosing the insulative housing and having a top wall, a bottom wall opposite to the top wall, a first side wall, a second side wall opposite to the first side wall, and a plurality of solder portions extending from the top and the bottom walls and beyond the rear face of the insulative housing.

11. The electrical connector as claimed in claim 10, wherein the insulative housing defines a top groove in the top face and a bottom groove in the bottom face thereof, and wherein each of the top and bottom walls of the metallic shell is farmed with a tab abutting against a rear end of the top and bottom grooves of the insulative housing.

12. The electrical connector as claimed in claim 10, wherein the insulative housing is formed with a pair of projections on the first side face thereof, and wherein the metallic shell defines a pair of gaps on the first side wall thereof and engaging with the pair of projections on the first side face of the insulative housing.

13. The electrical connector as claimed in claim 10, wherein the insulative housing is formed with a projection on the second side face thereof, and wherein the metallic shell defines a gap on the second side wall thereof and engaging with the projection on the second side face of the insulative housing.

14. An electrical connector assembly comprising:

an insulative housing defining a receiving space along a lengthwise axis in a front-to-back direction thereof;

a plurality of contact receiving passageways formed in the housing in communication with said space;

a plurality of contacts disposed in the corresponding passageways, respectively, and extending into the receiving space; and at least one of said contacts defining a body portion with a tail portion extending from a rear portion thereof, and a resilient arm extending from a front portion of the body portion along the lengthwise axis with a contact portion located at a distal end of the arm and laterally invading the receiving space, an extension formed at a distal free end of the contact portion and hold by a tab which extends from the body portion along said lengthwise axis; wherein said tab holds the extension in a lateral direction perpendicular to said lengthwise axis when no plug is inserted into the receiving space, while the extension is disengaged from the tab toward the body portion when said plug is inserted into the receiving space and engages and urges the contact portion; wherein said tab is stamped and split from the body portion and forms an opening in said body portion correspondingly.

15. An electrical connector comprising:

an insulative housing defining a receiving space and a first passageway communicating with the receiving space; and an electrical contact received in the first passageway and comprising a body portion, a resilient arm and a tab both extending from the body portion, the resilient arm having a contact portion projecting into the receiving space of the insulative housing and an extension extending from the contact portion, the tab having a pressing portion holding the extension of the resilient arm and deflecting the resilient arm toward the body portion; wherein the insulative housing comprises a front face, a rear face opposite to the front face, a top face, a bottom face opposite to the top face, a first side face, and a second side face opposite to the first face, the electrical connector further comprising a metallic shell enclosing the insulative housing and having a top wall, a bottom wall opposite to the top wall, a first side wall, a second side wall opposite to the first side wall, and a plurality of solder portions extending from the top and bottom walls and beyond the rear face of the insulative housing.

* * * * *